United States Patent [19]

Niemela

[11] 4,159,584

[45] Jul. 3, 1979

[54] PUSH BUMPER

[76] Inventor: W. Wally Niemela, Box 165E, Chassell, Mich. 49916

[21] Appl. No.: 793,085

[22] Filed: May 2, 1977

[51] Int. Cl.[2] ..... E01H 5/04

[52] U.S. Cl. ..... 37/44; 37/46; 280/481; 293/DIG. 1; 293/137; 293/132

[58] Field of Search ..... 37/41, 42, 44, 46, 50, 37/30; 172/27 C, 801; 293/DIG. 1, 60, 87, 89, 48–49; 280/481

[56] References Cited

U.S. PATENT DOCUMENTS

| | | | |
|---|---|---|---|
| 1,855,977 | 4/1932 | Llbet | 293/89 X |
| 2,646,287 | 7/1953 | Kytola | 293/DIG. 1 |
| 2,779,620 | 1/1957 | Reed | 293/DIG. 1 |
| 3,284,100 | 11/1966 | Goff | 280/481 |
| 3,378,084 | 4/1968 | Ulrich | 280/481 X |
| 3,907,333 | 9/1975 | Gianessi et al. | 280/481 X |

FOREIGN PATENT DOCUMENTS

| | | | |
|---|---|---|---|
| 920829 | 10/1954 | Fed. Rep. of Germany | 280/481 |
| 2235495 | 2/1974 | Fed. Rep. of Germany | 280/481 |
| 221597 | 9/1924 | United Kingdom | 293/60 |

*Primary Examiner*—E. H. Eickholt

*Attorney, Agent, or Firm*—Price, Heneveld, Huizenga & Cooper

[57] ABSTRACT

A push bumper is disclosed which is removably attachable to the front of a conventional snow plow and usable in pushing stalled vehicles and the like. The push bumper includes a rigid push plate, the front face of which is covered by a resilient material. The push plate is attached to the front of the snow plow through a hinge so that the plate pivots about a vertical axis and will follow the vehicle being pushed.

10 Claims, 8 Drawing Figures

PUSH BUMPER

BACKGROUND OF THE INVENTION

This invention relates generally to snow plows of the type attachable to the front of a vehicle and more particularly to an attachment for such snow plows for use in pushing stalled vehicles and the like.

Various forms of snow plows are presently available for use with light vehicles such as pick-up trucks, jeeps and other such utility vehicles. These plows are typically either rectilinear snow plows, that is, snow plows having blades with straight, ground engaging edges or hinged snow plows. The hinged snow plows include lateral blade sections hingedly connected at the center of the plow and shiftable from a forwardly extending V configuration to a recess or cupped configuration.

Such utility vehicles when equipped with the snow plow are typically used for the removal of snow from driveways, parking lots and the like. When plowing such areas, problems have been experienced with the presence of stalled and/or stuck vehicles. The vehicles hinder snow removal and must be pushed or towed from the area so that all of the snow may be plowed. Heretofore, another vehicle was required to tow or push the stalled vehicle from the area since the plow mounted on the front of the utility vehicle prevented its use as a push vehicle. The only way that such snow plow equipped vehicles have heretofore been able to push stalled or disabled vehicles without damaging such vehicles was to completely remove the snow plow assembly. Since this is a time consuming procedure, it is not generally practical for the removal of only one stalled vehicle. Full use of snow plow equipped vehicles is severely curtailed. Consequently, if another vehicle is not available to remove the stalled vehicles, they are left and proper and complete snow removal is not accomplished.

It can therefore be seen that a substantial need has existed for a simple, readily attachable and detachable device for use with snow plow equipped vehicles which would permit the use of the vehicle for pushing stalled or stuck vehicles without removal of the snow plow from the front thereof.

SUMMARY OF THE INVENTION

In accordance with the present invention, a unique push bumper attachment is provided whereby the problems heretofore experienced are substantially eliminated and a snow plow equipped vehicle is readily and quickly converted for pushing stalled vehicles without removal of the snow plow. Essentially, the push bumper attachment includes a support securable to the snow plow or other portion of the vehicle and a push member pivotally secured to the support so as to pivot about a vertical axis. Where the vehicle does not include a snow plow, the present invention may be pivotally secured to a bumper or other area to enable pushing stalled or other vehicles from straight on alignment, or when the vehicles are at an angle to one another.

In narrower aspects of the invention, a resilient, mar proof pad or coating is carried by the front face of the push blade to prevent damage to bumpers, grills, and/or other surfaces of the stalled vehicle contacted during use of the push bumper.

Further, in narrower aspects of the invention, the support includes a generally vertical or outwardly extending support plate attachable to an existing snow plow or which forms a part of an existing snow plow to which is secured at least one bushing. The rear face of the pusher plate is provided with a plurality of vertically spaced bushings positioned so that they may be placed in coaxial alignment with the bushing secured to the support plate. A removable, hinge pin is dropped downwardly through the bushings to pivotally and hingedly secure the push plate to the front of the snow plow.

Since the push plate is pivotally connected to the front of the snow plow, the plate will swivel during use to follow the vehicle being pushed. This feature eliminates damage to bumpers, grills and the like of the push vehicle and also substantially increases the versatility of the push bumper and vehicles so equipped.

DETAILED DESCRIPTION OF THE PREFERRED EMBODIMENT

Figure 1:
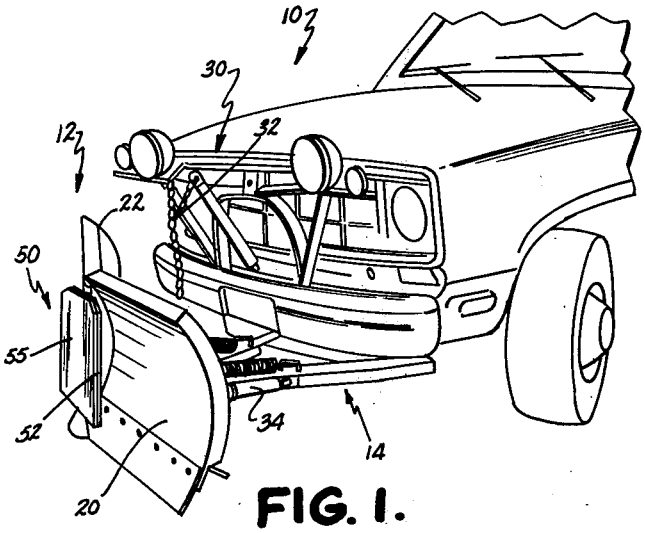
FIG. 1 is a fragmentary, perspective view of a snow plow equipped vehicle including the push bumper attachment in accordance with the present invention.
Figure 2:
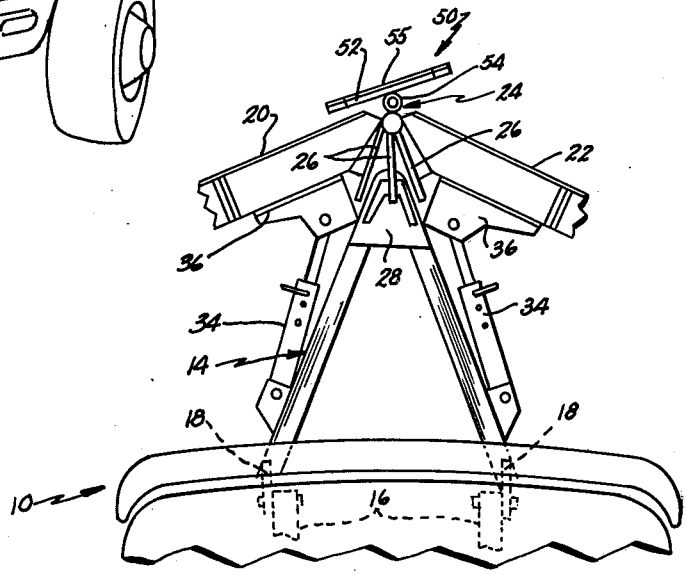
FIG. 2 is a fragmentary, top plan view of the snow plow equipped vehicle including the push bumper attachment in accordance with the present invention.

A snow plow equipped utility vehicle is partially illustrated in FIGS. 1 and 2 and generally designated 10. The vehicle is shown, for illustrative purposes only, as being equipped with a hinged snow plow generally designated 12. The hinged snow plow 12 illustrated in FIGS. 1 and 2 includes a triangular support frame 14 pivotally connected to the vehicle frame 16 at pivot support members 18. The plow 12 includes equal length lateral blade sections 20, 22 hingedly interconnected by a generally, vertical central hinge assembly 24. The central hinge assembly 24 is carried by support plates 26. The support plates 26 are in turn carried by frame 14 at the generally horizontal apex 28 of the frame. Typically, a lifting apparatus 30 is also secured to the front of the vehicle and connected to the frame 14 by a chain 32. The lifting apparatus 30 is employed to lift the plow 12 out of engagement with the ground.

Also, as seen in FIG. 2, the hinged plow illustrated in FIGS. 1 and 2 includes telescoping, positioning arms 34 extending from the side members of the frame 14 to support plate brackets 36 secured to the rear faces of the sections 21, 22 of the plow. The arms 34 are employed to shift the blade sections between a forwardly extending, V-shaped configuration and a recessed or cupped configuration.

The snow plow assembly 12 illustrated in FIGS. 1 and 2 is a typical example of a plow with which the push bumper in accordance with the present invention may be employed. However, the snow plow, per se, forms no part of the present invention. A detailed description of the snow plow illustrated in FIGS. 1 and 2 may be found in Applicant's commonly owned, copending U.S. patent application, Ser. No. 697,037, filed June 17, 1976 and entitled HINGED SNOW PLOW, CONVERSION KIT, AND METHOD THEREFOR.

Figure 4:
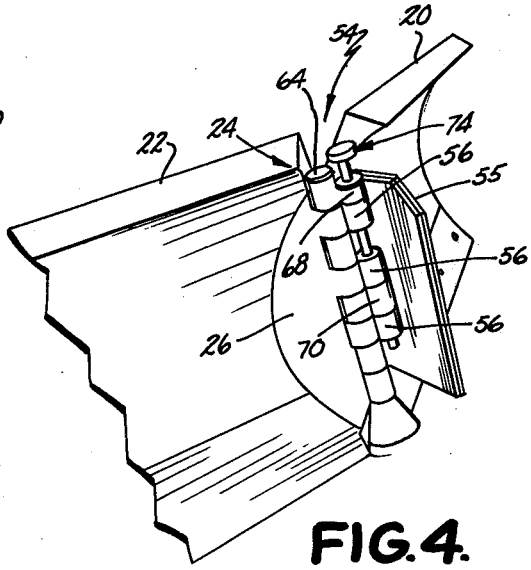
FIG. 4 is a fragmentary, elevational view showing the push bumper attachment in accordance with the present invention secured to the front of a snow plow.

The push bumper attachment in accordance with the present invention is illustrated in FIGS. 1, 2 and 4 and generally designated 50. The push bumper 50 includes a rigid push plate or member 52 which is preferably fabricated from a rigid steel material. The plate 52 is detachably and hingedly connected to the front of the snow plow 12, generally centrally thereof, by a vertical hinge means 54.

Figure 5:
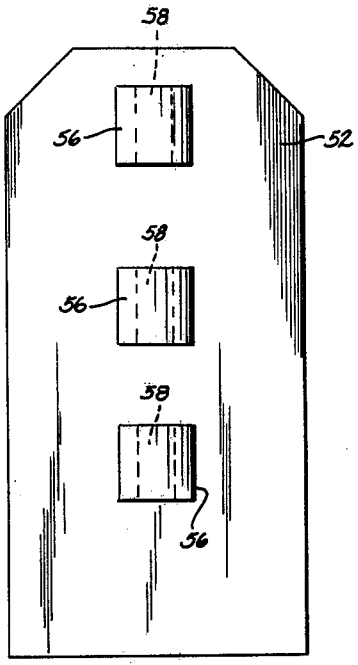
FIG. 5 is an enlarged, rear elevational view of the push bumper plate in accordance with the present invention.
Figure 6:
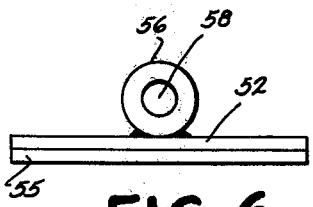
FIG. 6 is a top, plan view of the push bumper plate of FIG. 5.

As best seen in FIGS. 5 and 6, the pusher plate 52 is preferably an elongated, generally rectangular plate having a planar front face and a planar rear face. It is preferred that a resilient, mar proof or protective pad 55 of a suitable material such as rubber be secured to the front face of the push plate 52. For example, the pad may be coated directly onto the plate or secured by a suitable adhesive. The covering or pad 55, which preferably covers the entire face of the push plate 52, is provided to prevent damage to the vehicle being pushed as will be more fully explained below.

Secured to the rear face of the plate 52 are a plurality of bushings, collars or hinge knuckles 56. In the preferred embodiment, three such hinge knuckles or bushings are secured to the rear face of the plate 52. It is presently preferred that these bushings be fabricated from steel and that they be welded to the plate 52. The bushings are positioned in vertically spaced relationship and the bores 58 extending through the bushings are positioned coaxially of each other.

Figure 3:
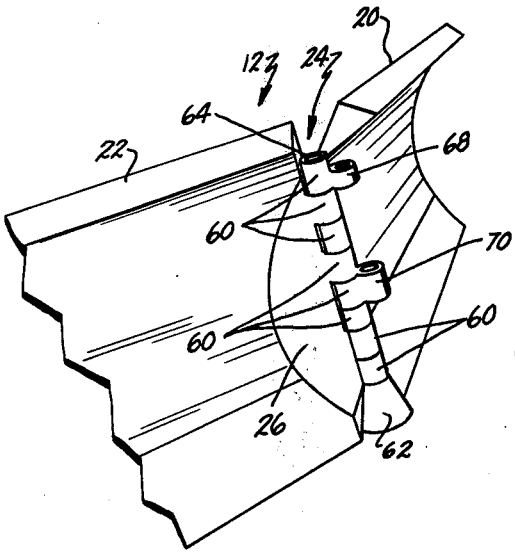
FIG. 3 is a perspective, elevational view showing a portion of the support attached to a snow plow in accordance with the present invention.

As best seen in FIGS. 3 and 4, provision is made for detachably securing the plate 52 to the front of the plow 12. The snow plow 12 which has been shown for illustrative purposes, includes the central hinge 24 as discussed above. As seen in FIGS. 3 and 4, the central hinge 24 includes a plurality of coaxially aligned, vertically positioned, tandem bushings 60, a cone-shaped foot 62 and a pivot pin 64 extending through the bushings 60. As more fully explained in the aforementioned U.S. patent application, the bushings are secured to respective ones of the blade section support plates 26 so that the blade sections 20, 22 may hinge or pivot about the pin 64.

Since the central hinge structure 24 is already existing in snow plows of the type illustrated, it is preferred that the push bumper attachment hinge means 54 be secured directly thereto.

As seen in FIGS. 3 and 4, it is presently preferred that a pair of bushings 68, 70 be welded or otherwise suitably secured in a coaxial, spaced relationship with each other, to respective spaced ones of the bushings 60. For example, as shown in FIG. 3, the upper bushing 68 may be secured to the top bushing of the hinge 24 and the lower bushing 70 may be secured to the fifth bushing down from the top of hinge 24.

When the push bumper attachment in accordance with the present invention is employed with a snow plow other than that of the type illustrated, bushings 68, 70 may be welded or otherwise suitably secured directly to the face of the snow plow or, if the plow is curved or concave in section, the bushing may be welded to a support plate such as the plate 26 illustrated which in turn is welded or otherwise suitably secured centrally of the snow plow blade.

It is presently preferred that some form of support plate 26 be employed with plows which do not already have a plate existent in a hinge assembly. The plate is required to position the bushings 68, 70 of the blade attached portion of the hinge means 54 outwardly and spaced from the front surface of the blade to permit proper swivel, pivoting or hinge action of the push plate 52, as more fully discussed below.

As seen in FIG. 4, the bushings or hinge knuckles 56 on the rear face of the plate 52 are spaced so that the upper one of the bushings 56 is positionable immediately below and coaxial with the bushing 68. The intermediate one of the bushings 56 is positionable coaxial with, adjacent and immediately above the lower bushing 70. The lower one of the bushings 56 is positionable immediately below and coaxial with the lower bushing 70. In this fashion, the bushing 70 is captured or sandwiched between the intermediate and the lower bushings 56 on the rear plate so that the plate is positioned vertically and supported by the bushing 70.

Figure 7:
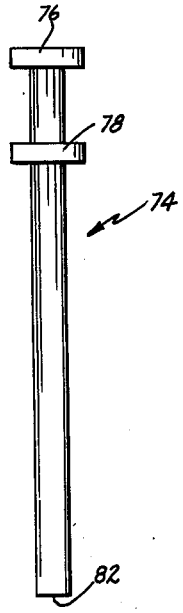
FIG. 7 is an elevational view of the hinge pin used with the push bumper attachment of the present invention.

A hinge pin 74 is inserted and extends through the bores 58 and the bushings 68, 70 and 56 to thereby hingedly secure the push plate 52 to the plow. As best seen in FIGS. 4 and 7, the hinge pin 74 is an elongated rod structure including a head 76 on one end and a spaced stop or stop flange 78 extending radially outwardly therefrom and positioned below the head 76. The rod or pin 74 is dimensioned so that the lower portion 80 thereof from the stop 78 to the end 82 will extend through the bushings 68, 70 and 56. As seen in FIG. 4, the stop 78 limits the downward movement of the pin relative to the bushings. The portion of the pin between the head 76 and the stop 78 defines an area for grasping the pin for manual removal thereof when it is desired to detach the push plate 52 from the plow. The knuckle or bushing 70 carried by the plow serves as a support member at which the push plate 52 is pivotally or hingedly secured through the two lower knuckles 56 and the hinge pin 74.

To assemble the push bumper attachment to an existing snow plow, the bushings 68, 70 are secured to the central hinge structure 24 of the plow, if the plow is a hinge type. If the plow is not of the hinge type, the bushings 68, 70 and a suitable support plate are preferably secured to the front of the plow, as explained above. Next, the plate 52 is positioned relative to the bushings 68, 70 so that the hinge pin 74 may be dropped down through the bushings to hingedly and pivotally secure the plate to the plow. The plate pivots about the vertical axis of the hinge pin which is spaced relative to the vertical centerline of the plate 52 so as to follow the vehicle being pushed.

Figure 8:
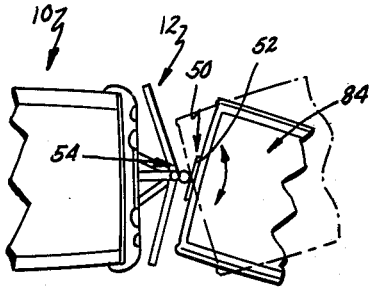
FIG. 8 is a fragmentary, schematic top plan view illustrating the operation of the push bumper attachment when secured to a snow plow equipped vehicle and used to push a stalled vehicle.

Once the push bumper attachment 50 is attached to the front of the plow, the snow plow equipped vehicle 10 may be employed to push a stalled vehicle 84, as schematically shown in FIG. 8. The rubber coated or covered front face of the plate 52 will contact the rear bumper, for example, of the stalled vehicle and will swivel with the vehicle, as shown in phantom, during pushing of the vehicle. Since the plate 52 will swivel or pivot relative to a vertical axis, the vehicle 10 may be employed to push the stalled vehicle 84 even if the stalled vehicle is positioned so that the vehicle 10 must approach the stalled vehicle 84 at an angle.

Since the plate 52 is positioned in front of the plow 12 and swivels relative thereto, the plate may be used to push a vehicle on an angle without damaging the rear bumper, grill or other surface of the vehicle contacted during pushing. It is preferred that the plate be dimensioned to extend substantially the entire distance between the upper and lower edges of the plow and cover at least the central area. This prevents the plate 52 from hooking above or below the bumper of the stalled vehicle. Since the front face is coated with a rubber or resilient pad, marring of the surface contacted is prevented or substantially eliminated. After the pushing operation is completed, the push plate 52 is easily and readily removed for storage in the cab or other area of the utility vehicle 10 by simply removing the hinge pin 74. All the operator need do is pull the pin out and the plate is ready for storage. The operator may then continue the plowing operation.

It can therefore be seen that Applicant's unique push bumper attachment may be readily used on existing snow plows and permits the snow plow equipped vehicle to be employed for pushing stalled vehicles and the like without removal of the snow plow and without damage to the vehicle being pushed. This results in substantial savings in the time required to plow snow covered areas, eliminates the need for a separate vehicle to remove stalled or stuck vehicles and also substantially increases the versatility of a snow plow equipped utility vehicle. Although illustrated and described in the context of an attachment to a snow plow, the push bumper could also be attached directly to the bumper or frame of the utility vehicle for increasing the versatility of the vehicle as a push vehicle.

In view of the above description, those of ordinry skill in the pertinent art will undoubtedly envision various modifications to the push bumper attachment illustrated which would not depart from the inventive concepts disclosed therein. For example, the configuration of the push bumper plate could be modified without effecting its operability and material other than rubber could be employed to coat the front surface of the plate to thereby prevent damage to the vehicle being pushed. Further, the relative positioning of the bushings on the rear of the plate 52 and on the front of a snow plow could be varied while still maintaining the pivoting or swivel or hinge action of the plate relative to the plow. Therefore, the above description should be considered as that of the preferred embodiment only. The true spirit and scope of the present invention may be determined by reference to the appended claims.

The embodiments of the invention in which an exclusive property or privilege is claimed are defined as follows:

1. A push bumper attachment to a conventional snow plow for use in pushing vehicles, said attachment comprising:

a support member attachable to the front of the snow plow and extending outwardly therefrom;

a rigid push plate; and means for hingedly securing said push plate to said support member and for permitting said push plate to pivot about a generally vertical axis so as to pivot with and follow the vehicle being pushed, said means for hingedly securing said push plate to said support member including:

a first knuckle carried by said support member;

a second knuckle carried at the rear face of said push plate at the vertical centerline of said push plate;

a third knuckle carried at the rear face of said push plate in vertically spaced, coaxial alignment with said knuckles;

a manually removable hinge pin extending through said first, said second and said third knuckles;

a fourth knuckle secured to the rear face of said push plate in vertically spaced, coaxial alignment with said second and said third knuckles; and a fifth knuckle carried by said support member in vertically spaced, coaxial alignment with said first knuckle, said hinge pin extending through said fourth and said fifth knuckles, said fourth knuckle being positioned below said fifth knuckle when said hinge pin extends therethrough, said support member dimensioned to position said hinge means outwardly and spaced from the snow plow to allow pivoting of said push plate.

2. A push bumper attachment as defined by claim 1 further including means carried by the front face of said push plate and positioned to contact the vehicle being pushed for preventing marring of the vehicle at the point of contact.

3. A push bumper attachment as defined by claim 2 wherein said marring preventing means comprises a resilient, rubber pad covering the front face of said push plate.

4. A push bumper attachment as defined by claim 7 wherein said hinge pin comprises an elongated rod having a head at the upper end thereof and a stop flange spaced below said head and extending radially outwardly therefrom.

5. In combination with a snow plow of the type attachable to the front of a vehicle and including a central hinge having a plurality of vertically spaced blade bushings, and a pair of blade sections each secured to alternate ones of said blade bushings, a push bumper for use in pushing vehicles, comprising:

a push member having generally planar front and rear surfaces; and means for detachably securing said push member to said snow plow at said blade bushings, whereby said blade sections may be positioned in a forwardly extending V configuration and said push member may be attached to said snow plow and used to contact a vehicle so that the vehicle may be pushed by the snow plow equipped vehicle, said means for detachably securing said push member to said snow plow including means for hingedly securing said push member to said blade bushings so that said push member may pivot about a line parallel with its vertical centerline.

6. The combination of claim 5 further including a resilient, rubber pad covering the front surface of said push member.

7. The combination of claim 6 wherein said means for hingedly securing said push member to said blade bushings comprises:

a first knuckle secured to one of said blade bushings intermediate the ends of said central hinge;

a second knuckle secured to the rear face of said push member at the vertical centerline thereof and intermediate the ends thereof;

a third knuckle secured to the rear face of said push member in vertically spaced, coaxial alignment with said second knuckle;

a manually removable hinge pin extending through said second knuckle, then said first knuckle and then said third knuckle, said first knuckle disposed between and coaxial with said second and said third knuckles;

a fourth knuckle secured to the rear face of said push member above and in vertically spaced, coaxial alignment with said second and third knuckles; and a fifth knuckle secured to another one of said blade bushings of said central hinge above and in coaxial alignment with said first knuckle, said fourth knuckle being disposed below and coaxial with said fifth knuckle, said hinge pin also extending through said fourth and said fifth knuckles.

8. The combination of claim 7 wherein said hinge pin comprises an elongated rod having a head at one end thereof and a stop flange, said stop flange being spaced below said head and extending radially outwardly therefrom, said stop flange resting on said fifth knuckle.

9. In combination with a snow plow of the type attachable to the front of a vehicle and including at least one plow blade extending in front of the vehicle when the plow is attached thereto, a push bumper for use in pushing vehicles, said push bumper comprising:

a support extending outwardly from said plow blade generally centrally of the vehicle;

a push member having a generally planar front surface and a rear surface; and means for detachably securing said push member to said support, said means for detachably securing said push member including hinge means for hingedly securing said push member to said support so that said push member may pivot about a generally vertical axis, said support being dimensioned to position said hinge means outwardly and spaced from said plow blade to allow pivoting of said push member, said means for hingedly securing said push member to said support comprising:

a first knuckle secured to said support;

a second knuckle secured to the rear surface of said push member at the vertical centerline thereof and intermediate the ends thereof;

a third knuckle secured to the rear surface of said push member in vertically spaced, coaxial alignment with said second knuckle;

a fourth knuckle secured to the rear surface of said push member in vertically spaced, coaxial alignment with said second and third knuckles;

a fifth knuckle secured to said support member in coaxial, spaced relationship with said first knuckle; and a manually removable hinge pin extending through said knuckles, said first knuckle disposed between and coaxial with said second and third knuckles.

10. The combination of claim 9 wherein said snow plow is a rectilinear plow having a straight ground engaging edge defined by said blade.

* * * * *

UNITED STATES PATENT AND TRADEMARK OFFICE

CERTIFICATE OF CORRECTION

PATENT NO. : 4,159,584

DATED : July 3, 1979

INVENTOR(S) : W. Wally Niemela

It is certified that error appears in the above-identified patent and that said Letters Patent are hereby corrected as shown below:

Column 6, line 29:

"7" should be --1--.

Signed and Sealed this

*First* Day of *January 1980*

[SEAL]

*Attest:*

SIDNEY A. DIAMOND

*Attesting Officer*

*Commissioner of Patents and Trademarks*